United States Patent [19]

Freiborg

[11] 4,439,955

[45] Apr. 3, 1984

[54] ASPHALT COMPOSITION HIP AND RIDGE COVER

[76] Inventor: Bennie Freiborg, 4536 Indiana Ave., La Canada, Calif. 91011

[21] Appl. No.: 300,106

[22] Filed: Sep. 8, 1981

Related U.S. Application Data

[63] Continuation-in-part of Ser. No. 188,876, Sep. 19, 1980.

[51] Int. Cl.[3] ..... E04D 1/20

[52] U.S. Cl. ..... 52/57; 52/276

[58] Field of Search ..... 52/518, 277, 276, 545, 52/523, 410, 270, 741, 57

[56] References Cited

U.S. PATENT DOCUMENTS

| | | | |
|---|---|---|---|
| 420,707 | 2/1890 | Toner | 52/270 |
| 1,362,755 | 12/1920 | Statler | 52/545 |
| 1,372,208 | 3/1921 | Statler | 52/545 |
| 1,471,396 | 10/1923 | Griswold | 52/523 |
| 2,084,699 | 6/1937 | North | 52/277 |
| 2,110,258 | 3/1938 | Blank | 52/276 |
| 2,429,480 | 10/1947 | Miller | 52/275 |
| 3,164,929 | 1/1965 | Boddie | 52/410 |
| 3,913,294 | 10/1975 | Freiborg | 52/518 |

*Primary Examiner*—John E. Murtagh

*Attorney, Agent, or Firm*—Blakely, Sokoloff, Taylor & Zafman

[57] ABSTRACT

An asphalt composition ridge cover and method of forming the same whereby a decorative appearance somewhat resembling that of a shake roof ridge cover is achieved. The ridge cover generally is a flat, approximately rectangular piece of asphalt composition roofing material, having a plurality of tabs at one end thereof which are multiplely folded over one another thereby forming a region of increased thickness at that end. When installed, the thickened portions give the ridge covers, and the ridge on which they are installed, the appearance of a shake shingle or tile roof while maintaining double coverage as required in many installations. One particular shape of the unfolded cover permits a very economical cutting of such covers from a roll of asphalt composition material.

14 Claims, 16 Drawing Figures

Fig. 4
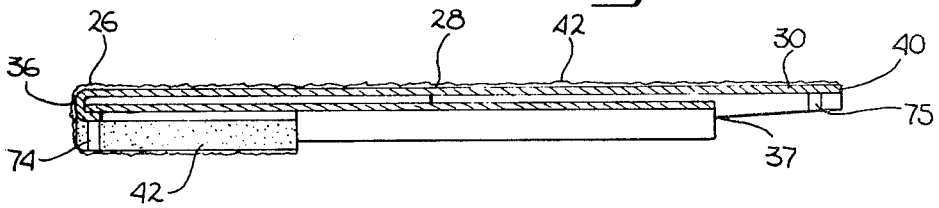
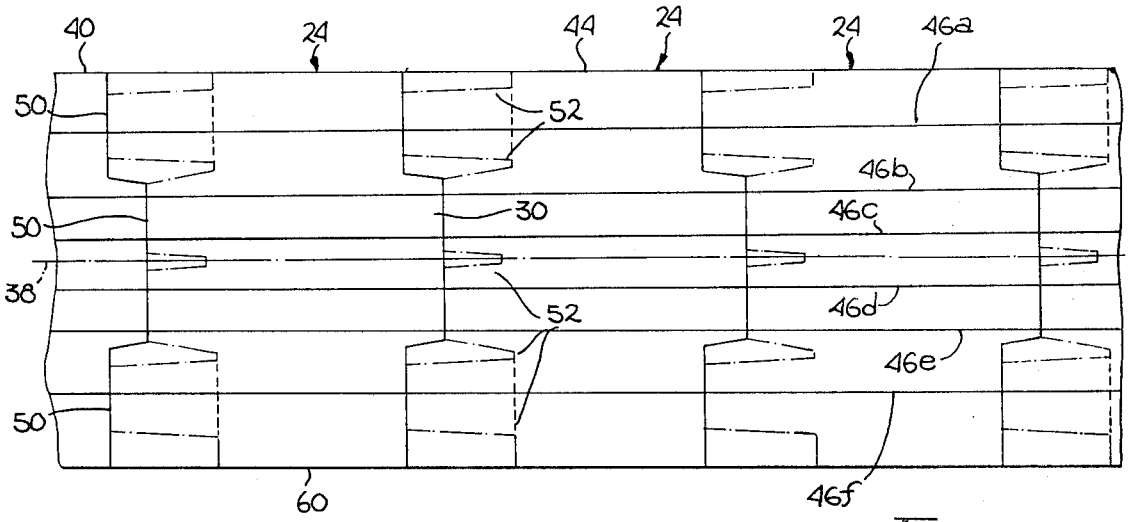
Fig. 5
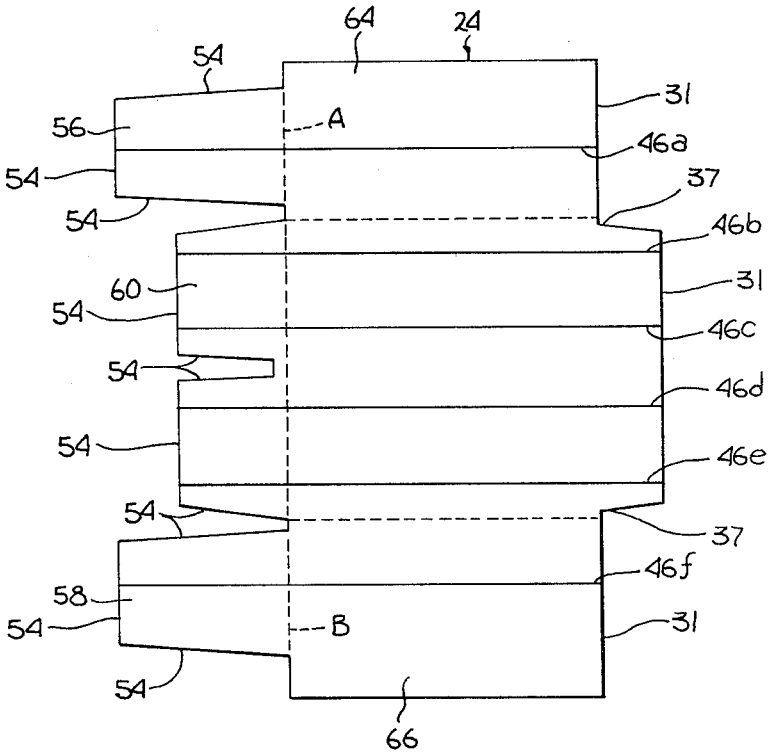
Fig. 6

Fig. 10
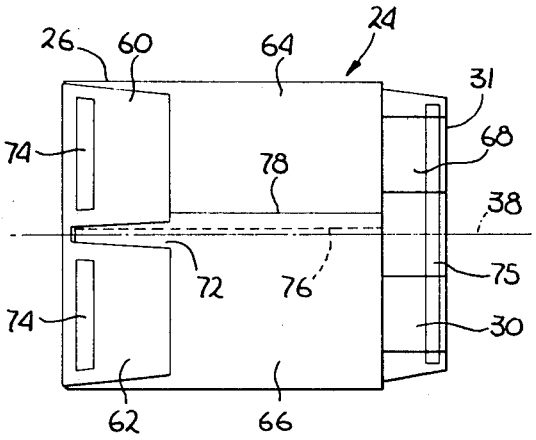
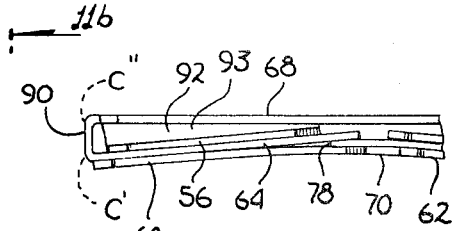
Fig. 11b
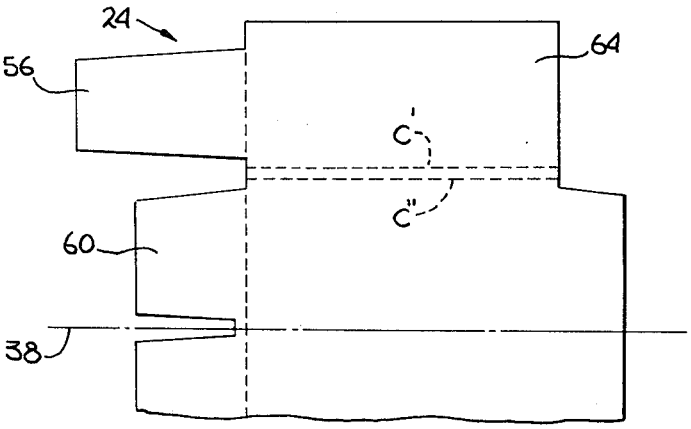
Fig. 11a
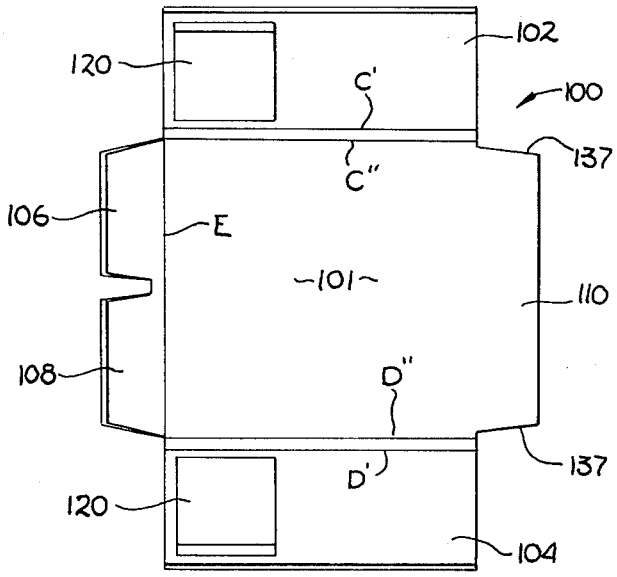
Fig. 12

ASPHALT COMPOSITION HIP AND RIDGE COVER

RELATED APPLICATIONS

This application is a continuation-in-part of my copending application Ser. No. 188,876, filed Sept. 19, 1980.

SUMMARY OF THE INVENTION

The present invention is employed in the fabrication of asphalt composition ridge covers to create an appearance similar to that of a shake shingle roof. The invention generally comprises a ridge cover which is formed by folding a plurality of tabs of an unfolded ridge cover over one another to create a ridge cover which gradually thickens as one proceeds from the back of the ridge cover toward the front of the ridge cover.

The first ridge cover is placed on the roof ridge in a normal manner. The second ridge cover is placed on the first such that the front end is set back about nine inches from the front end of the first ridge cover. Each additional ridge cover is deployed in a manner similar to the preceding ridge cover. The ridge covers appear, at the exposed end, 4 to 5 times as thick as the conventional asphalt shingle, creating an attractive appearance by adding a dimensional characteristic to the ridge cover while maintaining full double coverage. A suitable adhesive maybe used to facilitate installation.

In the presently preferred embodiment, the increased thickness is formed by folding multiple tabs which are placed and sized such that when all folds are completed, bending the ridge cover along its longitudinal centerline is easily accomplished, as only a single thickness of asphalt composition material need be bent. When the longitudinal bend is completed, the ridge cover then has the proper shape for installation on a ridge.

The shape and construction of the unfolded ridge cover are engineered to insure repeatably accurate folding of the ridge cover along predetermined lines.

BRIEF DESCRIPTION OF THE DRAWINGS

FIG. 4 is a cross section of a completed ridge cover formed according to the present invention.

FIG. 5 is a portion of a roll of asphalt composition material showing the layout for cutting multiple ridge covers therefrom.

FIG. 6 shows the configuration of the unfolded ridge cover of the present invention.

FIG. 10 shows the placement of adhesive to the preferred embodiment of the ridge cover of the present invention.

FIG. 11*a* shows the fold lines of an alternate embodiment of the present invention.

FIG. 11*b* shows the effect produced by folding along the fold lines of FIG. 11*a*.

FIG. 12 shows an alternate embodiment of the invention.

DETAILED DESCRIPTION OF THE INVENTION

Figure 1:
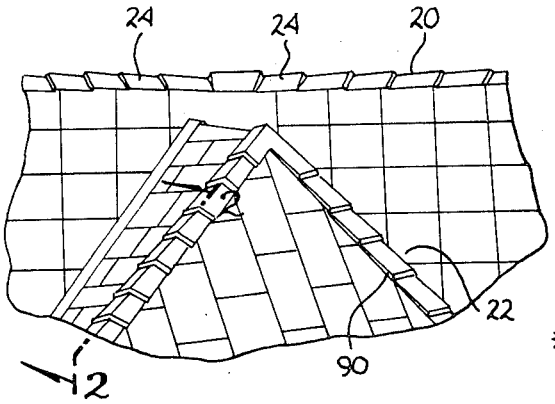
FIG. 1 is a drawing of a portion of a building roof illustrating the appearance of the ridge cover of the present invention.
Figure 2:
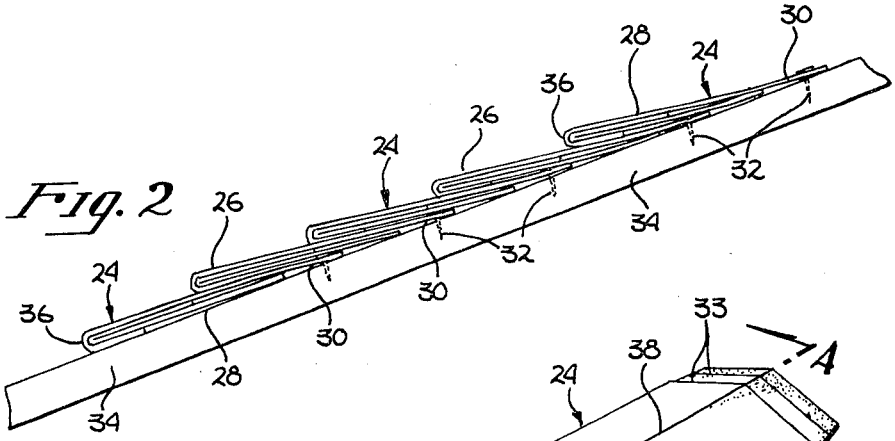
FIG. 2 is a cross section taken along line 2—2 of FIG. 1.

First referring to FIG. 1, an illustration of the present invention ridge cover, as installed on a typical roof, may be seen. It is to be understood that the phrase ridge cover, as used herein, is used in the broad sense to include hip covers and the like, and is used merely as a convenient phrase for identifying all such covers. It may be seen that the ridge 20 as well as the hip 22 is characterized by a pleasant physical appearance as a result of the raising of the outward extending end of the ridge covers to provide an apperance more like a shake roof ridge cover. The manner in which this is achieved in the preferred embodiment is illustrated in FIG. 2, which is a cross section taken along line 2—2 of FIG. 1.

Each ridge cover 24 is comprised of a front end portion 26, a middle portion 28 and a back end portion 30. When folded, the ridge cover is approximately 11 ½ inches long and 8 ¾ inches wide. When installed, the front end portion 26 of a second ridge cover 24 is placed over the back end portion 30 of a first ridge cover 24 so as to cover the nails 32 used to secure the first ridge cover at its back end portion 30 to the roof 34. Thus no nails 32 are left exposed. Typically, the front edge 36 of the second ridge cover 24 is set back approximately 9 inches from the front edge 36 of the first ridge cover. Successive ridge covers 24 are installed upward along a ridge 20 in a similar manner.

Figure 3A:
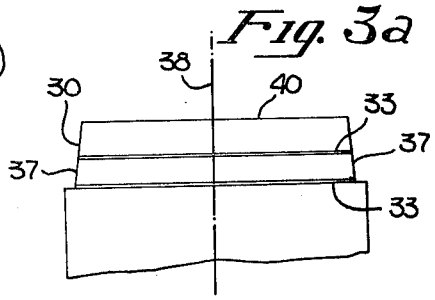
FIG. 3 is an illustration of three ridge covers shown in an exploded view to illustrate the manner in which each ridge cover is located with respect to another ridge cover.
Figure 3:
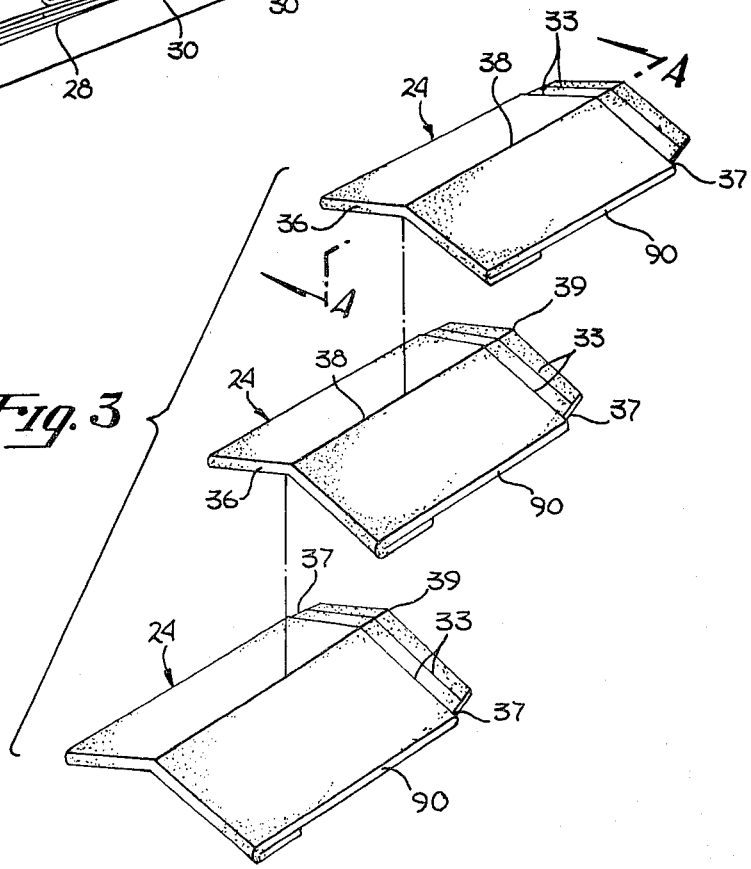

A perspective of the finished ridge cover 24 is shown in FIG. 3 clearly illustrating the smooth curved front edge 36 of each ridge cover. A tapered notch 37, best illustrated in FIG. 3*a*, is provided at each corner of the back end portion 30. The function of these notches 37 is partly cosmetic. Without the notch 37, the rear corners of a lower ridge cover would project sideways out from under the front edge 36 of the next ridge cover up the ridge. The notch 37 eliminates the unappealing projections. The notch 37 also serves as a guide to the roofer as to how far one ridge cover should overlap the other i.e., the distance from notch 37 to the front edge 36 is about 9 inches. The front edge 36 of one ridge cover should be installed so that it sits on the lower ridge cover at the lower end of a notch 37. This notch 37 eliminates the need for the roofer to measure, gauge or estimate overlap. The resulting overlap is uniform along the entire ridge 20.

Extending between the notches 37 across the back end portion 30 are two weep lines 33 designed to direct moisture, melted snow or driven rain to the sides of a ridge cover 24 and prevent it from being driven up and over the back end portion 30 onto the roof beneath.

What moisture passes the first weep line 33 is caught and channeled to the side by the second or higher weep line 33.

The thickness of each ridge cover 24 gradually decreases toward the back end portion 30 where the ridge cover 24 is as thick as a single sheet of conventional asphalt composition material. A slight bend 39 in the ridge cover 24 is located along the longitudinal centerline 38 of each ridge cover. The bend 39 gives the ridge cover 24 a pleasing appearance and permits the ridge cover to straddle the ridge 20 of the roof 34 and also lie in contact with the roof on both sides of the ridge 20. Because of the unique method of folding the ridge cover 24 as herein disclosed, the bend 39 is easily implemented upon installation. The degree of bending may vary through a wide range, and is somewhat influenced by the width of notch 72 discussed below. The ridge cover 24 is stored and shipped in a flat condition, i.e., without a bend 39 along the centerline 38. Upon installation the flat ridge cover 24 is removed from its container and bent by the installer along its centerline 38. This is easily effected as such bending requires bending of only a single thickness of asphalt composition material as is more fully explained with reference to FIGS. 8 and 9 below.

A detailed cross sectional view of the ridge cover 24 shows the manner of providing increased thickness at the front end portion 26. As shown in FIG. 4, the asphalt composition material comprises a layer of asphalt saturated felt 40, to one side of which is applied a thin layer of rock granules 42. The manner of folding provides for four thicknesses at the front end portion 26, three thicknesses reducing to two thicknesses in the middle portion 28 and a single thickness at the back end portion 30. A smooth curved front edge 36 is also provided by reason of the folding method disclosed herein.

The manufacture of the ridge cover 24 begins with a roll of asphalt saturated felt 40, a portion 44 of which is shown in FIG. 5. A number of beads of adhesive material 46*a*–46*f* are applied lengthwise along the roll after cutting. The portion 44 of the roll is cut along the lines shown in FIG. 5 to produce the unfolded ridge cover 24 shown in FIG. 6. The solid cutting lines 50 define the back edge 31 of a given ridge cover and a portion of the front edge 54 of an adjacent ridge cover. The phantom cutting lines 52 define a portion of the front edge 54 of the unfolded ridge cover 24. When cut along the solid cutting lines 50 and the phantom cutting lines 52, a plurality of ridge covers 24 are economically produced from a portion 44 of a roll of the asphalt saturated felt 40.

Figure 7:
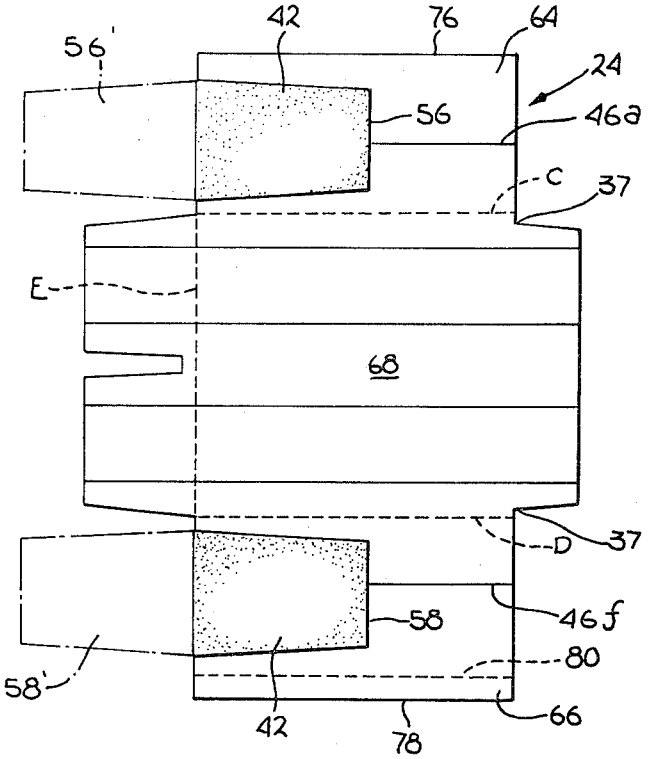
FIG. 7 shows the first folds made to the ridge cover of FIG. 6.

The bottom side of unfolded ridge cover 24 is best shown in FIG. 6. Beads 46*a*–46*f* of adhesive extend the length of the ridge cover 24. The position of bead 46*c* is carefully chosen such that the final fold does not cause tab 60 to adhere to the top side of section 66, thus leaving the edge of section 66 free to slide over section 64 as discussed below. This insures easy bending to form bend 39. Beads 46*a* and 46*f* are approximately centered on tabs 56 and 58, respectively. Beads 46*b* and 46*c* cooperate with bead 46*a* as a result of folding to secure the folded portions together. Similarly, beads 46*d* and 46*e* cooperate with bead 46*f*. The unfolded and first fold states of the ridge cover are illustrated in FIGS. 6 and 7, respectively. The ridge cover consists in part of a generally rectangular central body portion 68 having a first end delineated by the fold line E, a second end opposite and substantially parallel to the first end, a first edge delineated by the fold line C, and a second edge delineated by the fold line D.

The folding of ridge cover 24 occurs along fold lines A–E. The first folds, which are shown completed in FIG. 7, are made along perforated fold lines A and B (See FIG. 6). Tab 56 is folded about perforated fold line A such that the bottom of tab 56 contacts the bottom of section 64, thus a portion of adhesive bead 46*a* is folded back on itself and retains tab 56 in its folded position. Similarly tab 58 is folded about perforated fold line B such that the bottom side of tab 58 contacts the bottom of section 66 and a portion of adhesive bead 46*f* is folded back on itself and retains tab 58 in its folded position. The unfolded tabs 56 and 58 are indicated in phantom as 56' and 58' respectively. As shown in the various Figures tabs 56 and 58 are tapered, i.e., the base is wider than their free ends, however, it is considered obvious that the tabs 56 and 58 could be cut to have straight sides resulting in no taper. Fold lines A and B are perforated to insure that the folds repeatedly occur in a straight line located across the base of tabs 56 and 58. When these folds are completed, the ridge cover 24 will appear as shown in FIG. 7. The top of tabs 56 and 58 comprising layer 42 of rock granules are visible when the bottom of the ridge cover is viewed.

Figure 8:
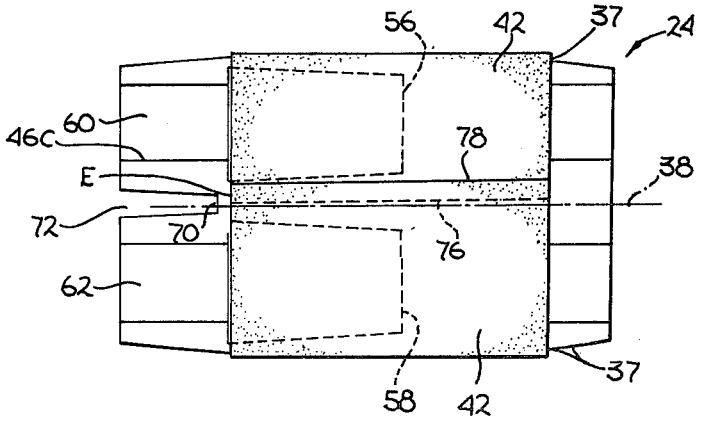
FIG. 8 shows the second folds made to the ridge cover of FIG. 6.

The second folds, which are shown completed in FIG. 8, are made along fold lines C and D of FIG. 7. Section 64 is first folded about fold line C so that the top side of tab 56 and the bottom of section 64 contact the bottom of section 68. Folded section 64 is held in position against slippage with respect to section 68, by the adhesive beads 46*a*, 46*b*, and 46*c*. When section 64 is properly folded, the outside edge 76 of section 64 lies very near the longitudinal centerline 38. Next, section 66 is folded about line D so that the top side of tab 58 and the bottom of section 66 contact the bottom of section 68. Folded section 66 is held fixed in its folded position, i.e. does not slip over section 68 by the cooperation of adhesive beads 46 *d,e* and *f*. When these two folds are completed, the top sides of sections 64 and 66, comprising a layer 42 of rock granules, is visible when viewing the underside of the ridge cover 24 as shown in FIG. 8. In addition, the outside edge 78 of section 66 overlaps the longitudinal centerline 38 as well as the outside edge 76 of section 64.

Figure 9:
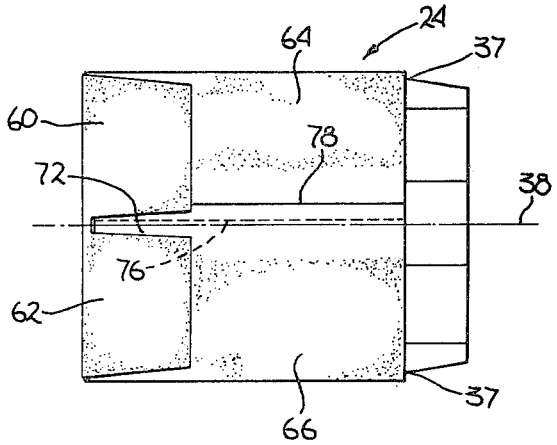
FIG. 9 shows the final fold made to the ridge cover.

The last fold, which is shown completed in FIG. 9, is made along fold line E of FIG. 8. As shown in FIG. 8, fold line E is located inwardly from the end 70 of notch 72 separating tabs 60 and 62. Tabs 60 and 62 are folded along fold line E such that the bottom of tabs 60 and 62 contact the top side (i.e., layer 42 of rock granules) of sections 64 and 66, respectively. As noted earlier, bead of adhesive 46*c* has been carefully located such that when tab 60 is folded, bead 46*c* does not contact any portion of section 66 even though section 66 extends (when folded) slightly beneath tab 60. Because the notch 72 does not extend fully to fold line E, folding of tabs 60 and 62 along fold line E produces a smooth front edge 36 with no hint of notch 72. When this last fold has been completed, the top sides of tabs 60 and 62 are visible when viewing the bottom of a ridge cover 24.

The completed and fully folded ridge cover 24 as shown in FIG. 9, is easily bent along its longitudinal centerline 38 as bending of only a single thickness of asphalt composition material is required. The thickness comprised of tabs 60 and 62 is not required to be bent because of the presence of notch 72. The thickness represented by sections 64 and 66 is not required to be bent because of the unique structure of the ridge cover. More specifically, the width of section 64, i.e., the distance between edge 76 and fold line C is very slightly less than the width from fold line C to longitudinal centerline 38. Also the width of section 66, i.e., the distance between edge 78 and foldline D is significantly greater than the width from fold line D to longitudinal centerline 38. As a result, when section 64 is folded along fold line C, edge 76 lies proximate the longitudinal centerline 38, and the body of section 64 is held fast in place by the adhesive beads. Similarly when section 66 is folded along fold line D, edge 78 overlaps the longitudinal centerline 38 and edge 76. The body of section 66 is held in place by adhesive beads 46*d*, 46*e* and 46*f*. However, that portion of section 66 which overlaps section 64 is not held in place by any adhesive (adhesive bead 46*c* having been placed such that it does not contact the overlapping portion of section 66). Section 66 has been slightly pre-creased as by running a narrow roller along precrease line 80 when the felt 40 is still relatively warm. This gives the felt 40 an induced tendency to bend at that precrease line 80. The precrease line 80 is positioned such that when section 66 is folded, line 80 will overlie the longitudinal centerline 38. Thus, when bend 39 is imparted to centerline 38 of a ridge cover, that portion of section 66 between precrease line 80 and edge 78 is free to slide over the stationary edge 76 of section 64 and will easily bend along precrease line 80 together with the bending along the longitudinal centerline 38 without significantly increasing the bending force beyond that required to bend a single thickness (i.e., section 68) of composition material 40. The thickness represented by tabs 56 and 58 is not required to bend as neither of tabs 56 or 58 lie along the longitudinal centerline 38, but rather, as shown in FIG. 8 lie one to each side of the centerline 38. Thus, only section 68 is required to bend in order to shape the ridge cover 24 for proper placement upon a ridge 20.

The above described structure of sections 64 and 66 and fold lines C and D also results in another advantage. Because edge 76 is folded proximate to longitudinal centerline 38 a roofer can literally form bend 39 blindfolded. Slight downward pressure on the edges 76 and 78 together with slight upward pressure on the underside of the ridge cover 24 will cause edge 76 to act as a fulcrum and cause bending about the edge 76 at the centerline 38. This edge 76 thus acts as a bending guide. This, together with the fact that the longitudinal centerline 38 has been slightly pre-creased (such as were fold lines C and D ) insures that the bend 39 is formed precisely along centerline 38 in an accurately repeatable manner on each ridge cover. This assures uniform product characteristics even when made on high volume production machinery.

As shown in FIG. 9, the rock granules 42 have not been applied to the asphalt composition material in the vicinity of the edges 76 and 78 respectively, of sections 64 and 66. Thus, where section 66 overlaps section 64 there are no granules on that area of section 64. The granules have been omitted for the purpose of decreasing the combined thickness of the overlapping portions of sections 64 and 66 to promote easier bending of the ridge cover 24 when forming the bend 39 along longitudinal centerline 38. If the granules 42 were left on the ridge cover 24, the bending along centerline 38 would cause a bunching-up of granules on the inside of the bend 39 and, as a result, the bending would tend more strongly to stretch and strain the fibers of the asphalt saturated felt 40. This would not only make bending more difficult but might also produce structural degradation of the felt 40. The reduced thickness of the overlapping edges 76 and 78 also means that no bulge results in tab 60 when it is folded over the overlapping edges as would result if the granules 42 were present on the overlapping regions of edges 76 and 78.

Once the final fold has been made and the ridge cover 24 has taken on the form shown in FIG. 9, the ridge cover is prepared for shipment and installation. The preparation for installation comprises the application of two regions of adhesive 74 on the underside of the front end portion 26 as shown in FIG. 10. The adhesive 74 will flow when heated by the sun's warmth to adhere the front end portion 26 of one ridge cover to the back end portion 30 of an underlying ridge cover. The back end portion 30 of each ridge cover is secured by nails 32 as shown in FIG. 2. The preparation for shipping comprises the application of a release film 75 to the underside of the back end portion 30 of each ridge cover 24. The release film 75 may be any one of a number of types of films which may be applied by painting, spraying, rolling or applied in the form of a tape. The essential feature of the release film 75 is that it adhere to the back end portion 30 and yet be readily releasable from contact with the adhesive 74. The release film 75 is used to prevent the adhesive 74 from adhering to the back end portion 30 of an underlying ridge cover when in the packed position. Since the ridge covers 24 are thicker at one end than at the other, the ridge covers are packed in pairs with their undersides facing each other and with the front end portion 26 of one ridge cover placed opposite the back end portion 30 of the other ridge cover 24. In this manner, the regions of adhesive 74 are placed opposite the release film 75 and the ridge covers do not adhere to one another other than to the release film. The release film 75 is readily separated from the adhesive 74 during unpacking.

While the above-described embodiment is entirely satisfactory from a functional standpoint certain esthetic improvements can be made. One such improvement is illustrated in FIGS. 11*a* and 11*b*. It has been found that when the folds are made along fold lines C and D, the layer of granules 42 and the underlying surface of asphalt saturated felt 40 tend to split, crack and separate. As a result, the visible side edges 90 formed by these folds and shown in FIGS. 1 and 3 may be somewhat cracked, ragged, irregular and undersirably dark in color. These undesirable features can be minimized or eliminated by the improvement illustrated in FIG. 11*a*. This improvement also provides a side benefit illustrated in FIG. 11*b*.

In FIG. 11*a*, the fold line C has been replaced by two fold lines C′ and C″ spaced on the order of $\frac{1}{4}$ to $\frac{3}{8}$ inches apart. These fold lines are actually slightly precreased by passing the still hot (100 F) saturated felt 40 under a pair of narrow rollers (not shown) which apply low pressure to the felt 40 thereby forming the fold lines C′ and C″. In a similar manner the fold line D is replaced by a pair of fold lines D′ and D″ (not shown). When section 64 is folded about the pair of spaced foldlines C′ and C″ the effective radius of curvature is larger than that produced by a single fold line C. The previously mentioned undesirable characteristics are therefore minimized or eliminated.

As a side benefit, the use of two fold lines C′ and C″ (as well as D′ and D″) produces a side edge 90 of increased thickness which forms a pocket 92 between tab 56, side edge 90 and the body portion 68 of the ridge cover 24. The presence of pocket 92 produces unique structural possibilities which lead to the alternate embodiment discussed below with reference to FIGS. 11*b* and 12.

In the first discussed embodiment, the increased thickness of the front end portion 26 of a ridge cover 24 is produced by multiple folds of the asphalt saturated felt 40, thus the thickness depends on the number of folds and the thickness of the asphalt saturated felt 40. To increase the thickness of the front edge 36 either additional folds must be made or the thickness of the felt must be increased. In the alternate embodiment the thickness of the front edge 36 is independent of the number of sections folded upon one another and independent of the thickness of the felt.

An asphalt composition ridge cover 100 constructed to included the above advantages is shown in FIG. 12. The ridge cover 100 has a central body portion 101, foldable edge tabs 102 and 104, foldable forward tabs 106 and 108 and a rear tab 110. The foldable tabs are shown in a partially folded position in FIG. 12. Tab 102 is first folded about fold lines C′ and C″ to provide a side edge comparable to side edge 90 of FIG. 11*b* having increased thickness thereby supporting tab 102 above central body portion 101 and forming a pocket comparable to pocket 92. Similarly, tab 104 is folded about foldlines D′ and D″ to provide a side edge such as 90 of increased thickness and also forming a pocket such as 92. The tabs 106 and 108 are then folded about fold line E closing the forward end of pockets 92. The volume of pockets 92 may then be filled with an appropriate filler material 93 to provide increased thickness to the front end portion of ridge cover 100. The filler material 93 can be any material which will suitably fill pockets 92 to the desired thickness and be sufficiently firm to maintain the thickness. A sprayed-in foam urethane, which hardens after a time may be conveniently used. Other suitable materials and methods for using or applying same are readily available. It can thus be seen that the thickness of the front end of ridge cover 100 depends on the separation between fold lines C′, C″ and D′, D″ and the amount of filler material 93 placed in pockets 92. Because this alternate embodiment only requires formation of a pocket such as 92 and not multiplely folded layers of the asphalt composition material 40, the first pair of tabs 56 and 58 of the first embodiment have not been incorporated into the second embodiment as illustrated in FIG. 12. In addition, the asphalt composition material of the second embodiment can be of reduced thickness, thus providing a reduction in weight of the ridge cover 24.

It is, of course, contemplated that the pocket 92 feature of the second embodiment (including the use of filler material) could be incorporated into the first embodiment and other features of the first embodiment could be used with the second embodiment. As examples, the pre-crease line 80 could easily be used, and preferably would be used, in the second embodiment in combination with the partial overlap of tab 102 by tab 104 to insure easy and repeatably accurate formation of bend 39. The second embodiment could, of course, also be provided with notches 137 comparable to notches 37 of the first embodiment.

The filler material 93 can be placed within pockets 92 after folding or ridge cover 100 is completed or the filler material may be adhered to the forward end portion of each of tabs 102 and 104 prior to folding, such as are filler pads 120 of FIG. 12, such that upon folding, the filler material occupies pocket 92 as in FIG. 11*b*.

As thus far described the ridge cover may have the shape shown in either of FIGS. 11*a* or 12 with the preferred shape being as shown in FIG. 11*a*. It has been found that minor refinements may be made to the shape of FIGS. 11*a* to further improve the appearance and ease of folding of the ridge cover 24. These refinements are illustrated in ridge cover 200 shown in FIG. 13.

Ridge cover 200 has a pair of longer tabs 202 and 204 whose sides 206 and 208 are straight and not tapered as were the corresponding sides of tabs 56 and 58. This reduces the volume and weight of waste material produced when the ridge cover is cut out from a roll of composition material. Ridge cover 200 also has a pair of shorter tabs 210 and 212. Each of these shorter tabs 210 and 212 are separated from the respective adjacent one of the longer tabs by a deeper notch 214. The notches 214 are defined by the straight edge 206 of longer tabs 202 and 204 and the adjacent edges of the shorter tabs 210 and 212, as defined by sections 216 and 218 of the edge. Section 216 is a short section near the bottom 215 of the notches 214 which is straight and parallel to the longitudinal centerline 224. Section 218 is a longer edge section joining the shorter edge section 216 to the free end of tabs 210 and 212 and is a tapered edge. Section 216 lies between the pairs of fold guiding means, i.e., creases C′ and C″ and D′ and D″. This geometry provides a small area of asphalt composition material between the edges 216 and each of creases C″ and D″. This small area of material improves the appearance of the forward corners of the ridge cover 200 in its fully folded state.

Another feature not illustrated previously is the rounded bottom 220 of the notch 222 separating tabs 210 and 212. The rounded bottom 220 improves the bending qualities of the ridge cover 200 when the final bend is made along longitudinal centerline 224 of the fully folded ridge cover. The bending qualities are further improved by the presence of notches 226 whereby a tapered portion of asphalt composition material is removed from between perforations A and B and the lines 228 defining the forward edge of a corner of foldable portions 230 and 232 (which fold about creases C′, C″ and D′, D″ respectively).

An improvement to the other end of the ridge cover 200 is effected by providing V shaped notches 234 on each side of central tab 236 where the tab 236 meets the rear edge 238 of the ridge cover 200. The bottom 240 of each V notch 234 is positioned to lie between the creases C′ and C″ and D′ and D″. The placement of the bottom 240 of notches 234 between each pair of creases improves the appearance of the fold, made about creases C′, C″ and D′, D″, at its rear end and in addition serves as an overlap guide as do notches 137 of FIG. 12 and notches 37 of FIG. 3*a*.

Ridge cover 200 is folded and bent in a manner analogous to the folding performed on the ridge cover 24 of FIG. 11*a* and shown in FIGS. 6–9.

Figure 14:
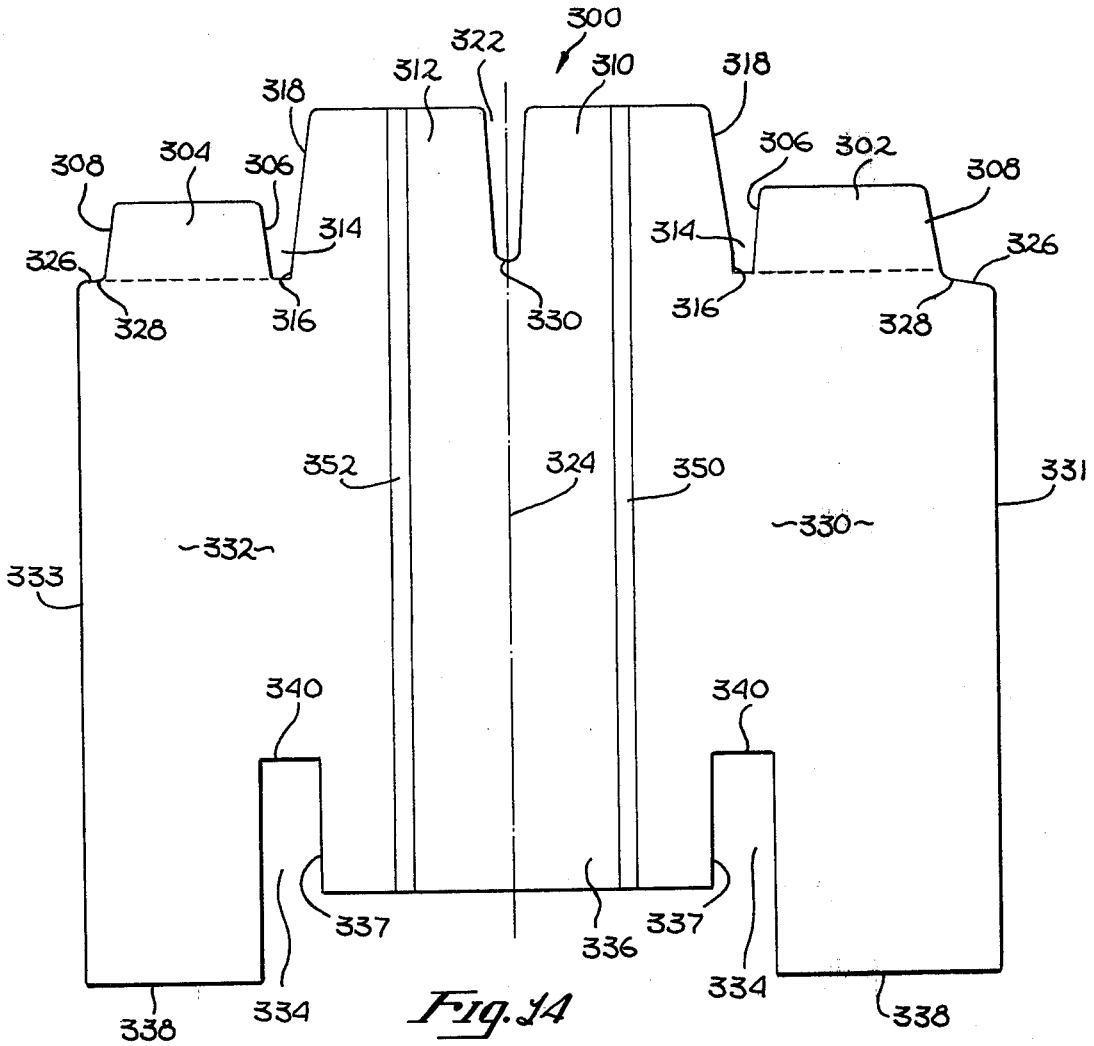
FIG. 14 illustrates another alternate shape for the blank from which is made an alternate configuration of ridge cover.

A second alternate embodiment of ridge cover may be made from the ridge cover blank 300 illustrated in the unfolded state in FIG. 14. This ridge cover blank 300 is very similar to the ridge cover blank 200, and corresponding parts of ridge cover 300 have been given corresponding numbers except raised by 100. Thus the central tabs 310 and 312 correspond to the central tabs 210 and 212 of the ridge cover blank 200.

Figure 13:
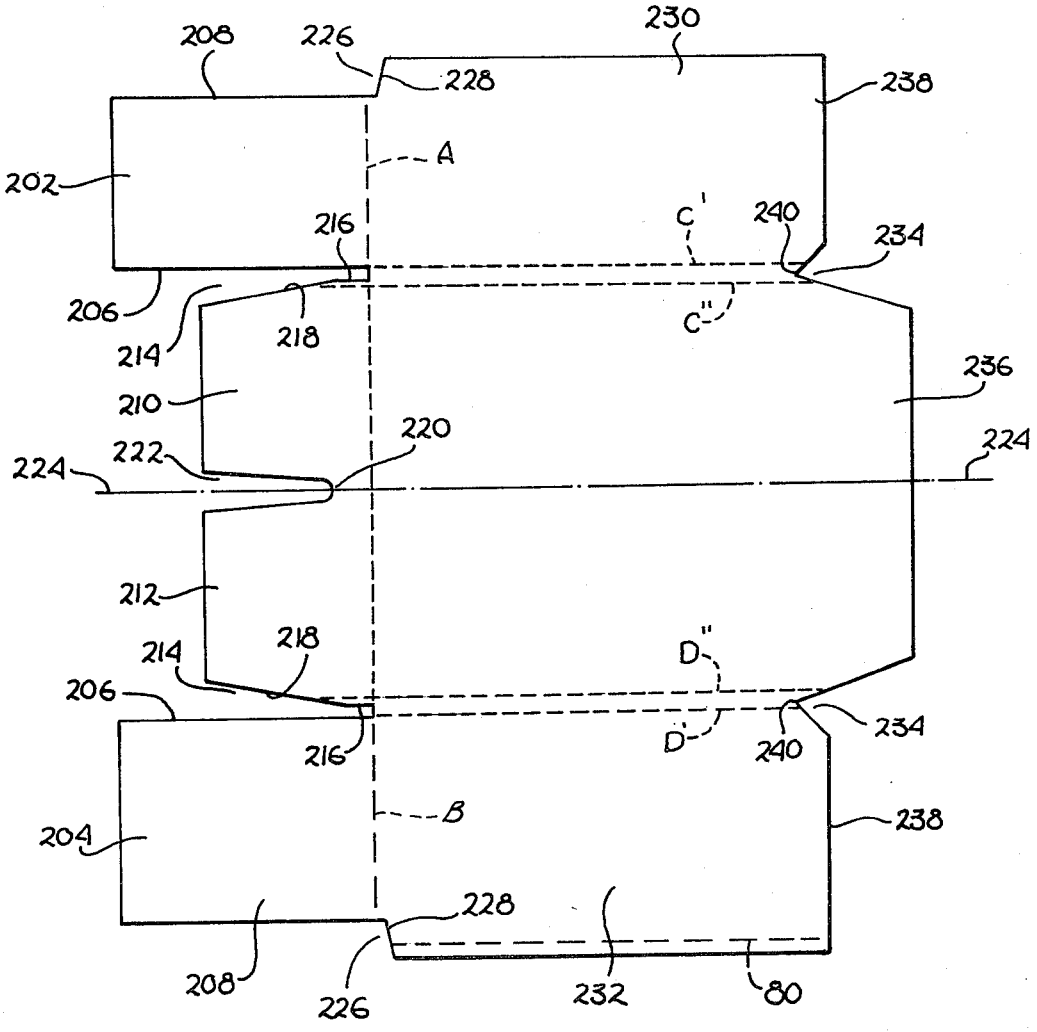
FIG. 13 illustrates an alternate shape of ridge cover blank.

Because the ridge cover blank 300 is so similar to the ridge cover blank 200 of FIG. 13, only the differences between the ridge covers 200 and 300 will be discussed.

The ridge cover blank 200 has a pair of longer tabs 202 and 204, whereas tabs 302 and 304 are the shorter tabs of ridge cover blank 300. The sides of tabs 302 and 304 are tapered rather then straight as are tabs 202 and 204.

The ridge blank 300 has rearwardly extending straight sided tabs 360 and 362. No such comparable tabs are found on ridge blank 200. The tabs 360 and 362 are formed from the material which has been "removed" from tabs 302 and 304 to shorten them. Thus, the length of tabs 360 and 362 (from the bottom of notch 334 to their rearward edge 338) is the same as the length by which tabs 202 and 204 have been shortened to form tabs 302 and 304.

Other differences include the placement and number of adhesive (asphalt) strips 350 and 352 as compared to strips 46*a*–46*e* shown in FIGS. 5 and 6. Such strips 46*a*–46*e* could also be employed on ridge cover 200, and of course the configuration of strips 350 and 352 could be used as well on ridge cover 200. Notches 334 have a flat bottom 340 whereas notches 234 are V-shaped (see 240). The side edges of tab 236 are sloped whereas tab 336 has straight side edges 337.

Other features of the ridge cover blank 300 are essentially identical to corresponding features of ridge cover 200. For example, the folding lines of ridge cover 300 are the same as those of cover 200 and to keep the FIG. 14 as uncrowded as possible the fold lines have not been shown in FIG. 14. Tab 336 also would be provided with weep lines similar to weep lines 33 shown in FIG. 3*a*.

Just as in the prior embodiments, one side section 330 is wider than the other side section 332, and tab 360 is wider than tab 362. Section 330 and tab 360 are sufficiently wide such that when folded about the fold line passing through notch 314 and notch 334, the section 330 will slightly overlap the centerline 324. Thus when the ridge cover 300 is installed on a ridge of a roof and bent along its centerline 324 to conform to the slope of the ridge, the section 330 and tab 360 are bent slightly near their edge 331, along a line proximate the centerline 324. This is shown more clearly in the rear end view shown in FIG. 15.

Figure 15:
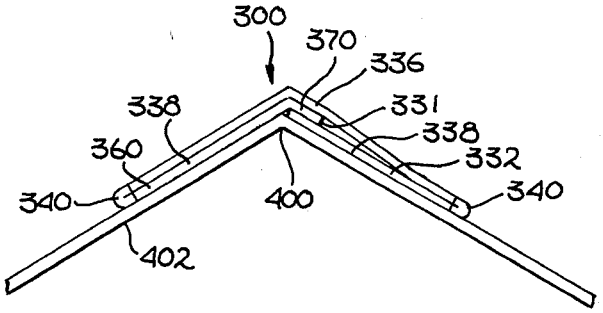
FIG. 15 is a rear end view of the ridge cover formed from the blank of FIG. 14 as it would appear installed on a roof ridge.

A folded ridge cover 300 may be placed on the ridge 400 of a roof 402 as shown in FIG. 15. The ridge cover 300 is folded slightly along its centerline 324. From the rear of the ridge cover 300, the rear edges 338 of the tabs 360 and 362 and the rear edge of the tab 336 are visible. Because tab 360 is wider than tab 362 and because section 330 and tab 360 are folded over prior to folding over section 332 and tab 362, the edge 331 of section 330 overlaps the edge of section 332 near the centerline 324, to form bend 370.

Figure 16:
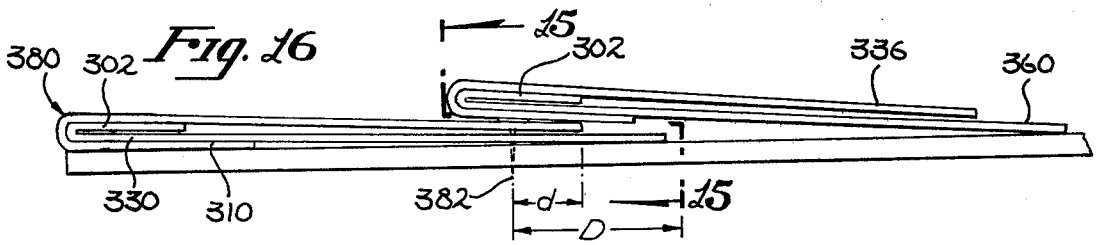
FIG. 16 is a cross sectional view taken along the line 16—16 of FIG. 15.

The bend 370 adds stiffness to the section 330 and tab 360. This stiffness together with the length of the rearwardly extending tab 360 increases the ability of the ridge cover 300 to resist being lifted up at its front end 380 such as by a strong wind. This feature is best illustrated in FIG. 16. If the ridge cover 200 was placed on a ridge and nailed in place in the same manner as ridge cover 300 in FIG. 16, the rearward most extension of ridge cover 200 would be the rear edge of central tab 236 (equivalent to the rearward edge of tab 336 shown in FIG. 16). If a strong wind comes along tending to lift the front end of ridge cover 200, the ridge cover 200 would tend to pivot about the nail 382. This tendency to pivot would be resisted by the length of material extending behind the nail 382. For ridge cover 200, this is the length d between the nail and the rear edge of centrtl tab 336. For ridge cover 300, the rearward most extension of the ridge is the rear edge of tabs 360 and 362. Tabs 360 and 362 are significantly longer than central tab 236 or 336. Hence the length D is much greater than d and a greater lever arm is available to resist the pivoting of the ridge cover 300 than is available to resist pivoting of ridge cover 200.

The procedure for forming a completed ridge cover from ridge cover blank 300 is very similar to the folding procedure of the other embodiments. First, tabs 302 and 304 are folded so that their felt side contacts the felt side of sections 330 and 332 respectively. Second, section 330 is folded, about the fold line (or lines) passing through notches 314 and 334, so that its felt side contacts the strip of adhesive 350 and its edge 331 lies on the other side of the centerline 324. Third, section 332 is similarly folded about the fold lines (or lines) passing through notches 314 and 334 so that edge 333 is proximate (but remains on the same side of) centerline 324. Fourth, tabs 310 and 312 are folded over onto sections 330 and 332 such that the felt side of (and the adhesive thereon) the tabs contacts the granule coated side of sections 330 and 332. Thus, the front end of the ridge cover is four thicknesses of asphalt composition material, quickly reduces to three thicknesses, quickly reduces to two thickness and near the rear end reduces to a single thickness as shown in FIG. 16.

There has thus been provided a novel shaped asphalt composition piece which has a number of tabs that when properly folded produce a ridge cover of increased thickness at its front edge yet when bent along its longitudinal centerline only one thickness must be bent. The shape of the unfolded ridge cover is carefully chosen so that a series of such covers may be economically cut from a roll of asphalt composition material with minimal waste. While the description of the preferred embodiment has been with specific reference to FIGS. 1–11, and the description of alternate embodiments have been made with reference to FIGS. 11 through 16, it should be understood that various modifications, additions and substitutions may be made to the structure and method of the invention without departing from the spirit and scope of the invention as defined in the appended claims.

What is claimed is:

1. An asphalt composition ridge cover comprising a unitary sheet of asphalt composition roofing material characterized by a substrate of asphalt saturated felt and a layer of granules on the top surface thereof bonded to the saturated felt by a layer of asphalt, said ridge cover further comprising:

a generally rectangular central body portion having a first end, a second end, a first edge, a second edge and a longitudinal centerline;

a first pair of tabs integrally formed with said first end;

a first edge tab integrally formed with said first edge and a second edge tab integrally formed with said second edge;

a second pair of tabs coupled to said first edge tab and second edge tab respectively, proximate said first end, said second pair of tabs being shorter than said first pair of tabs;

said first edge tab and said means for increasing the thickness of said first edge tab being folded into contact with a first portion of said central body portion;

said second edge tab and said means for increasing the thickness of said second edge tab being folded into contact with a second portion of said central body portion;

said first pair of tabs being folded about said first end and folded over said first edge tab and said second edge tab;

whereby one end of the ridge cover is provided with increased thickness and a smooth rounded appearance.

2. The ridge cover according to claim 1 further comprising a central tab integrally formed with said second end.

3. The ridge cover according to claim 2 wherein said central tab is provided with at least one weep line on its top surface.

4. The ridge cover according to claim 2 wherein said central tab is provided with a pair of notches one placed on each side central tab where said central tab meets said second end.

5. The ridge cover according to claim 2 further comprising a third pair of tabs integrally formed with said second end of said ridge cover.

6. The ridge cover according to claim 5 wherein one of said third pair of tabs is located on each side of said central tab.

7. The ridge cover according to claim 5 wherein said third pair of tabs is longer than said central tab by a distance substantially equal to the distance by which said second pair of tabs is shorter than said first pair of tabs.

8. The ridge cover according to claim 1 wherein said first edge tab is wider than said first portion of said central body portion such that said first edge tab, folded into contact with said first portion of said central body portion, also extends beyond said longitudinal centerline and partially into contact with said second portion of said central body portion.

9. A method for forming a ridge cover of a blank of a unitary sheet of asphalt composition roofing material characterized by a substrate of asphalt saturated felt and a layer of granules on the top surface thereof bonded to the layer of saturated felt by a layer of asphalt, comprising the steps of:

providing a ridge cover blank comprising:

(a) a generally rectangular central body portion having a first end, a second end, a first edge, a second edge and a longitudinal centerline;

(b) a first pair of tabs integrally formed with said first end;

(c) a first edge tab integrally formed with said first edge and a second edge tab integrally formed with said second edge;

(d) a second pair of tabs each shorter than said first pair of tabs and integrally formed with a respective one of said first and second edge tabs and located proximate said first end;

folding said second pair of tabs into contact with its respective edge tab;

folding said edge tabs and respective one of said second pair of tabs, into contact with said central body portion;

folding said first pair of tabs about said first end and over said first and second edge tabs and respective one of said second pair of tabs;

whereby a ridge cover is formed having a smooth rounded appearance at one end and is thicker at said one end than at its other end.

10. The method of claim 9 wherein one of said first and second edge tabs is folded prior to the other.

11. The method of claim 9 wherein one of said first and second edge tabs is wider than the other.

12. The method of claim 11 wherein the wider one of said first and second edge tabs is folded after the other edge tab is folded, and partially overlaps said other edge tab.

13. The method of claim 9 further comprising the step of:

providing a plurality of strips of adhesive extending parallel to said centerline and from the free end of said first pair of tabs to the second end of said ridge cover, said providing being effected prior to folding.

14. The method of claim 9 further comprising the steps of:

applying an adhesive material to said first pair of tabs on their granule side, beneath and proximate said first end of said ridge cover; and applying a release film to the underside of said second end of said ridge cover;

said applying being effected after said folding.

* * * * *